US009782638B2

(12) United States Patent
Kim

(10) Patent No.: US 9,782,638 B2
(45) Date of Patent: Oct. 10, 2017

(54) BALL FEEDING DEVICE

(71) Applicant: CLOUDGATE CORP., Seoul (KR)

(72) Inventor: Seongjun Kim, Seoul (KR)

(73) Assignee: CLOUDGATE CORP. (KR)

( * ) Notice: Subject to any disclaimer, the term of this patent is extended or adjusted under 35 U.S.C. 154(b) by 0 days.

(21) Appl. No.: 15/417,196

(22) Filed: Jan. 26, 2017

(65) Prior Publication Data

US 2017/0209748 A1 Jul. 27, 2017

(30) Foreign Application Priority Data

Jan. 27, 2016 (KR) ..... 10-2016-0009776

(51) Int. Cl.

| | |
|---|---|
| ***F41B 4/00*** | (2006.01) |
| ***A63B 47/00*** | (2006.01) |
| ***A63B 69/40*** | (2006.01) |
| ***A63B 69/00*** | (2006.01) |

(52) U.S. Cl.

CPC ..... *A63B 47/00* (2013.01); *A63B 69/0002* (2013.01); *A63B 69/40* (2013.01); *A63B 69/406* (2013.01); *A63B 2069/0008* (2013.01); *A63B 2208/0204* (2013.01)

(58) Field of Classification Search

CPC ..... A63B 69/406; F41B 4/00; F41B 11/50; G07F 11/00

See application file for complete search history.

(56) References Cited

U.S. PATENT DOCUMENTS 2,209,340 A * 7/1940 Landry ..... B65G 47/1471 198/443
3,306,613 A * 2/1967 Mainers ..... A63B 69/406 124/6
3,468,407 A * 9/1969 Furst ..... B65B 69/00 198/397.06
3,653,538 A * 4/1972 Lamar ..... B60P 3/007 124/51.1
4,025,071 A * 5/1977 Hodges ..... A63B 69/406 124/51.1
4,082,177 A * 4/1978 Aidlin ..... B65G 47/1471 198/443
4,841,945 A * 6/1989 Braden ..... A63B 69/406 124/1
4,896,646 A * 1/1990 Kahelin ..... A63B 47/002 124/50

FOREIGN PATENT DOCUMENTS

| | | | |
|---|---|---|---|
| JP | 06054933 | A | 3/1994 |
| KR | 101067455 | B1 | 9/2011 |
| KR | 101132001 | B1 | 3/2012 |
| KR | 101239527 | B1 | 3/2013 |
| KR | 101262786 | B1 | 5/2013 |

* cited by examiner

*Primary Examiner* — John Ricci
(74) *Attorney, Agent, or Firm* — Renaissance IP Law Group LLP

(57) ABSTRACT

A ball feeding device includes: a ball transfer tube comprising a ball lifting tube and a ball feeding tube; and a ball transfer module connected to the ball lifting tube and transferring the ball. The ball transfer module includes: a first rotating portion and a second rotating portion connected to opposite end portions of the ball lifting tube, respectively; a driving motor connected to the first rotating portion; a link connecting the first rotating portion and the second rotating portion; and a main support portion supporting the ball, the main support portion coupled to the link and passing through the ball lifting tube.

17 Claims, 10 Drawing Sheets

BALL FEEDING DEVICE

CROSS-REFERENCE TO RELATED APPLICATION

This application claims priority under 35 U.S.C. §119 to Korean Patent Applications No. 10-2016-0009776, filed on Jan. 27, 2016, in the Korean Intellectual Property Office (KIPO), the disclosures of which are incorporated by reference herein in its entirety.

BACKGROUND

1. Field

Embodiments of the invention relate to a ball feeding device, and more particularly, to a ball feeding device including a support portion for a ball transferred through a ball lifting tube.

2. Description of the Related Art

Pitching devices are a machine that pitch a ball to a batter for baseball batting practices. The pitching devices help batting practices not only for baseball players, but also for the general public who enjoy baseball as a hobby.

In recent times, screen baseball games are popular in which pitching and hitting may be played by projecting images such as pitchers on the screen. In a screen baseball game, the pitching machine pitches balls based on users' needs.

Accordingly, for the pitching machine to pitch balls continuously, a ball feeding device is used to supply balls to the pitching machine. In such an example, a ball feeding portion of the pitching machine has a predetermined height from the ground, and thus the ball feeding device needs to transfer balls from the ground to at least the height of the ball feeding portion.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the invention are directed to a ball feeding device capable of lifting balls from the ground to a predetermined height.

According to one embodiment of the invention, a ball feeding device includes: a ball transfer tube including a ball lifting tube and a ball feeding tube; and a ball transfer module connected to the ball lifting tube and transferring the ball. The ball transfer module includes: a first rotating portion and a second rotating portion connected to opposite end portions of the ball lifting tube, respectively; a driving motor connected to the first rotating portion; a link connecting the first rotating portion and the second rotating portion; and a main support portion supporting the ball, the main support portion coupled to the link and passing through the ball lifting tube.

The first rotating portion may include a first sprocket and a first rotation shaft, the second rotating portion may include a second sprocket and a second rotation shaft, and the link may include a chain.

The ball feeding device may further include brackets fixed to the ball lifting tube. Opposite end portions of each of the first rotation shaft and the second rotation shaft may be supported by the brackets.

At least a portion of the link may move while being inserted in the ball lifting tube.

The ball lifting tube may have a first opening defined in a side surface, and the link may be inserted into the first opening.

The ball transfer module may further include: an auxiliary support portion pivotally connected to the driving motor and supporting a ball, at least a portion of the auxiliary support portion being inserted into the first opening of the ball transfer tube.

The auxiliary support portion may include a portion having a circular plate shape having a support groove on a portion of a circumference of the circular plate.

The auxiliary support portion may include a portion having a circular plate shape including a support protrusion on an outer circumferential surface of the circular plate.

An interval among the main support portions may be substantially the same as a length of an outer circumference of the first rotating portion.

The main support portion may include a curved surface convex toward a moving direction of the link.

The ball lifting tube may have a second opening defined in an upper surface thereof.

The ball feeding device may further include a ball detection sensor at the ball transfer tube, the ball detection sensor detecting that the ball passes through a predetermined position.

The ball transfer tube may have a predetermined inclination with respect to a horizontal plane.

The ball feeding device may further include a ball guide portion connected to the ball lifting tube.

The ball feeding device may further include: a pitching unit connected to the ball feeding tube and pitching a ball; and a control unit controlling operations of the ball transfer module and the pitching unit.

The control unit may apply, to the ball feeding device, a first signal for transferring a ball to the pitching unit and may apply, to the pitching unit, a second signal for pitching the ball.

The control unit may apply the second signal after a predetermined time elapses after the first signal is applied.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present disclosure of invention will be more clearly understood from the following detailed description taken in conjunction with the accompanying drawings, in which.

DETAILED DESCRIPTION

Figure 1:
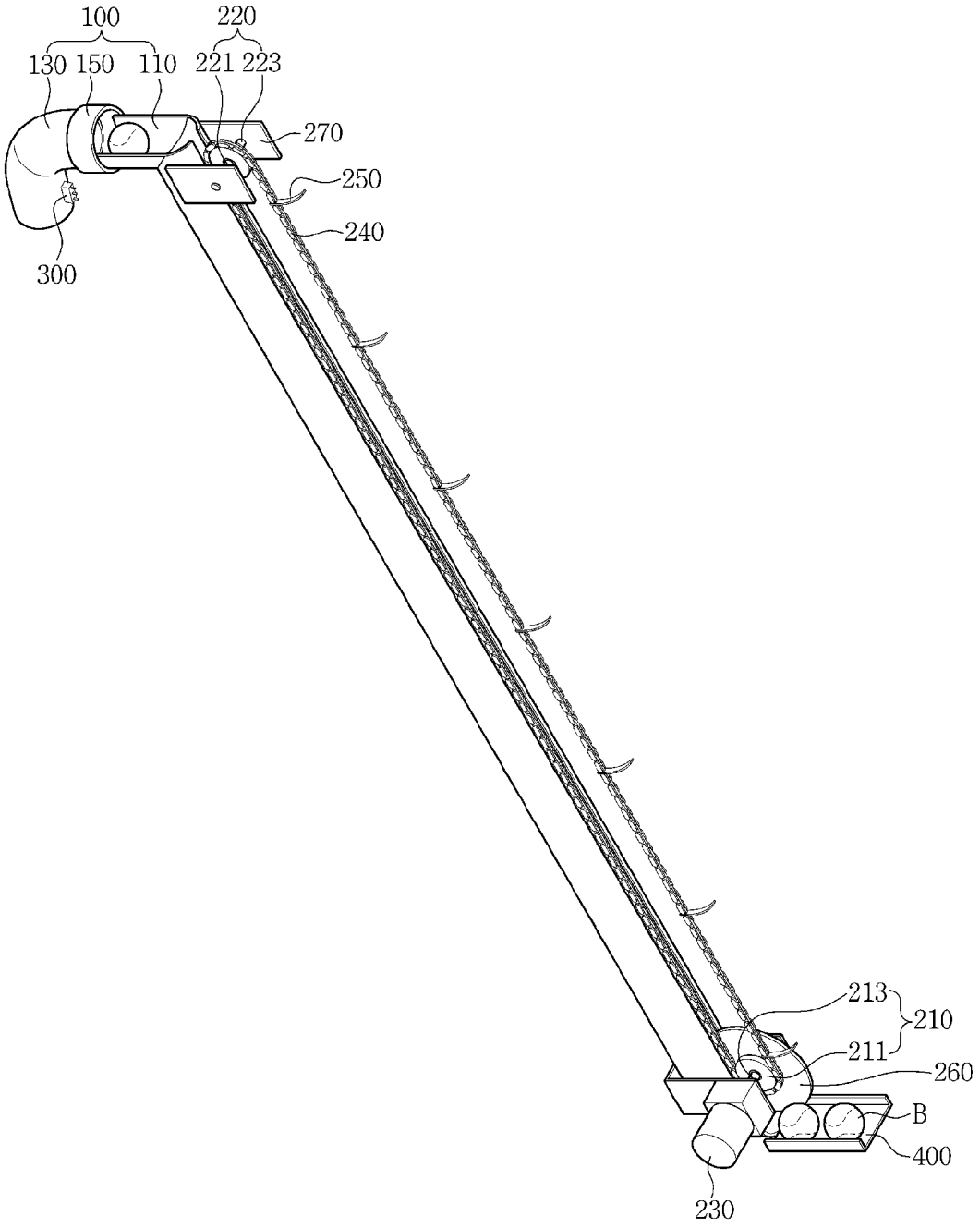
FIG. 1 is a perspective view illustrating a ball feeding device according to an exemplary embodiment.

Advantages and features of the invention and methods for achieving them will be made clear from embodiments described below in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. The invention is merely defined by the scope of the claims. Therefore, well-known constituent elements, operations and techniques are not described in detail in the embodiments in order to prevent the invention from being obscurely interpreted. Like reference numerals refer to like elements throughout the specification.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "less", "above", "upper", and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction, and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Some of the parts which are not associated with the description may not be provided in order to specifically describe embodiments of the present invention, and like reference numerals refer to like elements throughout the specification.

Hereinafter, a ball feeding device 10 according to an exemplary embodiment will be described with reference to the drawings.

Figure 2:
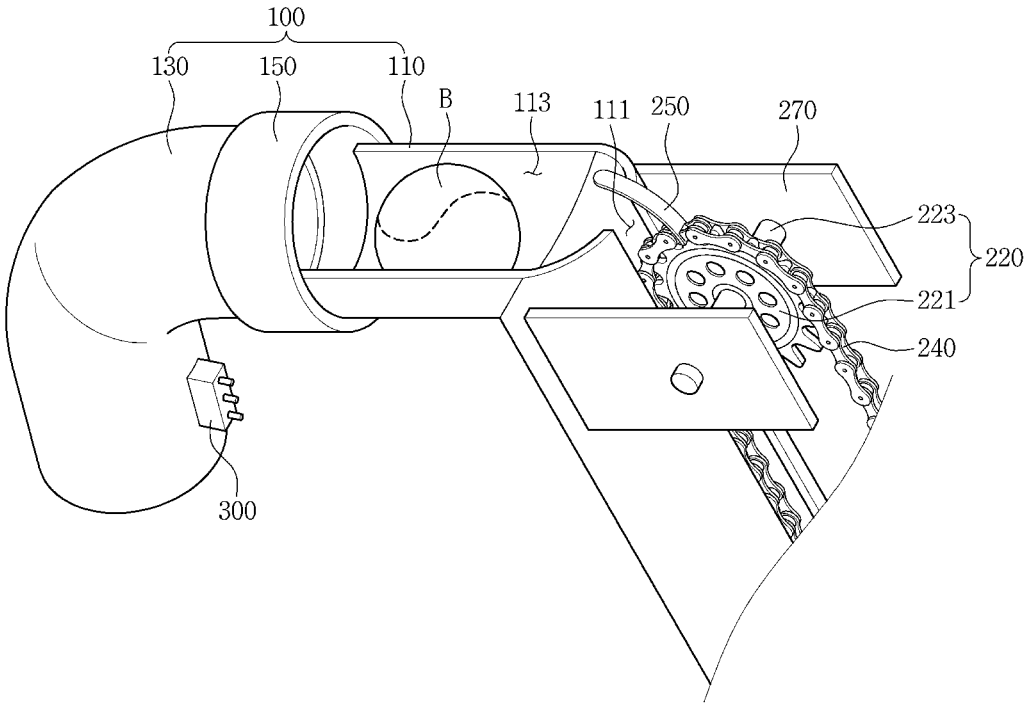
FIG. 2 is a first enlarged view illustrating a portion of the ball feeding device illustrated in FIG. 1.
Figure 3:
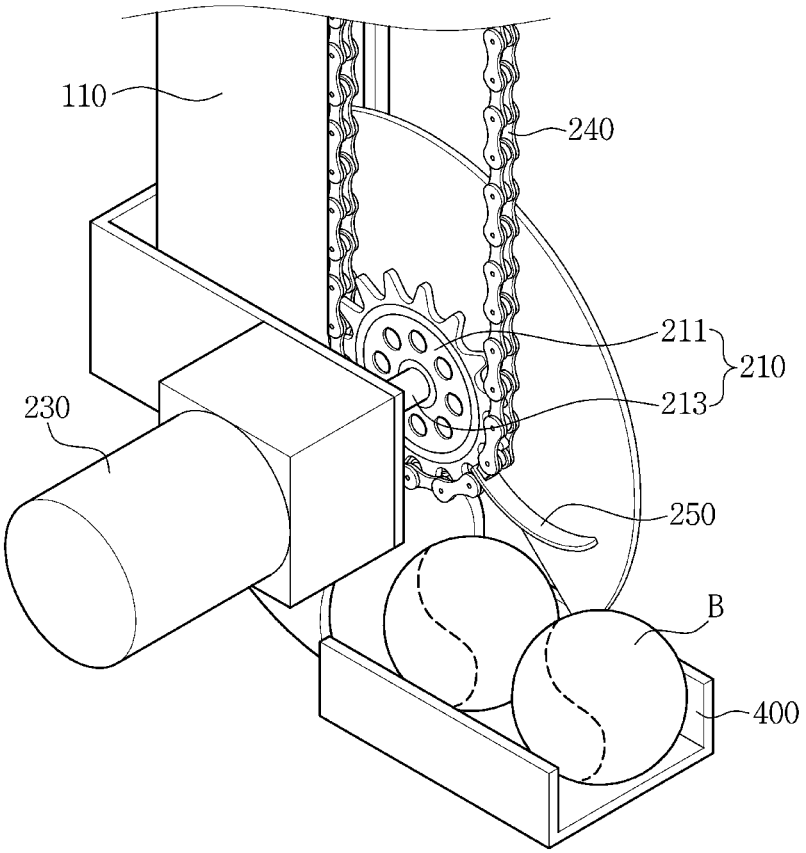
FIG. 3 is a second enlarged view illustrating a portion of the ball feeding device illustrated in FIG. 1.

FIG. 1 is a perspective view illustrating the ball feeding device 10 according to an exemplary embodiment, FIG. 2 is a first enlarged view illustrating a portion of the ball feeding device 10 illustrated in FIG. 1, and FIG. 3 is a second enlarged view illustrating a portion of the ball feeding device 10 illustrated in FIG. 1.

Referring to FIGS. 1, 2 and 3, the ball feeding device 10 according to an exemplary embodiment includes a ball transfer tube 100, a ball transfer module 200, a ball detection sensor 300, and a ball guide portion 400.

Referring to FIG. 2, the ball transfer tube 100 is a cylindrical passage through which a ball B may be transferred. The ball B is lifted from the ground through the ball transfer tube 100 and the lifted ball B may be supplied to a pitching unit 500.

The ball transfer tube 100 according to an exemplary embodiment includes a ball lifting tube 110 and a ball feeding tube 130.

The ball lifting tube 110 according to an exemplary embodiment covers at least a portion of the ball transfer module 200, to be described below, in order to substantially prevent the ball B from falling off a transfer path. In such an exemplary embodiment, the ball B is supplied to a lower end portion of the ball lifting tube 110 and moves to an upper end portion of the ball lifting tube 110. The lower end portion of the ball lifting tube 110 may be connected to the ball guide portion 400 to be described below, and the upper end portion of the ball lifting tube 110 is bent at a predetermined angle to smoothly discharge the lifted ball B.

The ball lifting tube 110 has a height suitable to supply the ball B to the pitching unit 500, to be described below, and has a width larger than a diameter of the ball B to be transferred. In addition, the ball lifting tube 110 has a predetermined inclination with respect to the ground surface to smoothly discharge the ball B.

Referring to FIG. 2, the ball lifting tube 110 may have a first opening 111 defined along a height direction on one side. The first opening 111 according to an exemplary embodiment is defined along the height direction on a rear surface of the ball lifting tube 110 and a link 240 to be described below is inserted thereinto.

In addition, the ball lifting tube 110 has a second opening 113 defined on an upper surface thereof.

The second opening 113 is defined in order to substantially prevent congestion of the balls B in the ball feeding tube 130 in the case of an unstopped operation of the ball transfer module 200 due to abnormal operation of the ball detection sensor 300, to be described below.

The ball feeding tube 130 is connected to one end portion of the ball lifting tube 110. For example, the ball feeding tube 130 is connected to an upper end portion of the ball lifting tube 110 to discharge the ball B in a desired direction. The ball feeding tube 130 according to an exemplary embodiment is bent toward the ground and discharges the ball B in a downward direction.

The ball transfer tube 100 may further include a connection tube 150, in which case the ball feeding tube 130 and the ball lifting tube 110 may be stably coupled to each other. According to an exemplary embodiment, opposite end portions of the connection tube 150 are connected to the ball lifting tube 110 and the ball feeding tube 130, respectively.

Referring to FIGS. 1, 2 and 3, the ball transfer module 200 may be disposed on a rear surface of the ball transfer tube 100. The ball transfer module 200 includes a first rotating portion 210, a driving motor 230, a second rotating portion 220, the link 240 and a main support portion 250.

The first rotating portion 210 is connected to the ball transfer tube 100 and includes a first sprocket 211 and a first rotation shaft 213 connected to the first sprocket 211. For example, at least a portion of the first rotating portion 210 is fixed to the ball transfer tube 100.

The first sprocket 211 according to an exemplary embodiment is disposed at a lower end portion of the ball lifting tube 110 and is rotated by the driving motor 230 to be described below. Opposite end portions of the first rotation shaft 213 are connected to a bracket 270, and the bracket 270 is connected to the ball lifting tube 110 to fix the first rotating portion 210.

In an alternative exemplary embodiment, the first rotation shaft 213 and the bracket 270 may be integrally formed.

The second rotating portion 220 is connected to the ball transfer tube 100, and includes a second sprocket 221 and a second rotation shaft 223 connected to the second sprocket 221. For example, at least a portion of the second rotating portion 220 is fixed to the ball transfer tube 100.

The second sprocket 221 according to an exemplary embodiment is disposed at an upper end portion of the ball lifting tube 110. Opposite end portions of the second rotation shaft 223 are connected to a bracket 270 and the bracket 270 is connected to the ball lifting tube 110 to fix the second rotating portion 220.

The driving motor 230 is connected to the first rotation shaft 213 to provide a driving force to the first rotating portion 210. In one embodiment, the driving motor 230 may be a step motor including a stator and a rotor. The stator includes a pair of coils disposed to face each other to form a plurality of pole pairs. In addition, the pair of coils include a plurality of pairs of coils. Accordingly, in the case where a current flows in one pair of coils of the plurality of pairs of coils, the rotor rotates toward another pair of coils. That is, when the polarity of the coil changes continuously and alternately, the rotor rotates a predetermined angle in response to the change of the coil polarity.

In an exemplary embodiment, the driving motor 230 may be protected by a motor case.

The link 240 connects the first rotating portion 210 and the second rotating portion 220. For example, the link 240 connects the first rotating portion 210 and the second rotating portion 220, covering outer circumferential surfaces of the first rotating portion 210 and the second rotating portion 220. Accordingly, when the first rotating portion 210 rotates, the link 240 moves in a same direction as a rotation direction of the first rotating portion 210.

The link 240 according to an exemplary embodiment may be a chain. In the case where the link 240 is a chain, an interval of grooves defined in the chain may be set so that the grooves mesh with teeth of the first rotating portion 210 and the second rotating portion 220.

In addition, at least a portion of the link 240 may be inserted into the first opening 111 defined in the ball lifting tube 110. In such an exemplary embodiment, when the link 240 is turned, at least a portion of the link 240 may move in the ball transfer tube 100.

The main support portion 250 is coupled to the link 240 and supports the ball B while moving in accordance with the rotation of the driving motor 230. Since a portion of the link 240 is inserted in the ball lifting tube 110 to move, the main support portion 250 also passes through the inside of the ball lifting tube 110 and supports the ball. In such an exemplary embodiment, as the ball B is supported by the main support portion 250 and guided by the ball lifting tube 110, the ball B may be stably lifted up to the ball feeding tube 130.

According to an exemplary embodiment, the main support portion 250 has a curved surface convex toward a moving direction of the link 240. In such an exemplary embodiment, when lifted up to an end portion of the ball lifting tube 110 by being supported by the main support portion 250, the ball B may spontaneously move to the ball feeding tube 130 due to the curve of the main support portion 250. In addition, the curved surface of the main support portion 250 serves as a guide for the ball B, and may substantially prevent the ball B from deviating off the ball feeding device 10 through the second opening 113.

According to an alternative exemplary embodiment, the main support portion 250 may be a stick or a bar. In such an exemplary embodiment, the main support portion 250 has a shorter length than a diameter of the ball lifting tube 110 so as to be inserted into the ball lifting tube 110.

The main support portion 250 may be coupled to the link 240 by an attachment. For example, attachments for connecting the main support portion 250 to the link 240 may be provided on the link 240 at a predetermined interval, and coupled to the main support portion 250 by bolts.

An interval among respective ones of the main support portions 250 may be substantially equal to or a multiple of an outer circumferential length of the first rotating portion 210. In such an exemplary embodiment, mounting surfaces of the main support portion 250 and an auxiliary support portion 260, to be described below, are substantially simultaneously inserted into the ball transfer tube 100. Accordingly, the main support portion 250 and the auxiliary support portion 260 may substantially simultaneously contact the ball B to effectively lift the ball B.

However, exemplary embodiments are not limited to the above description, and the predetermined interval may be arbitrary set within a necessary range.

Figure 4:
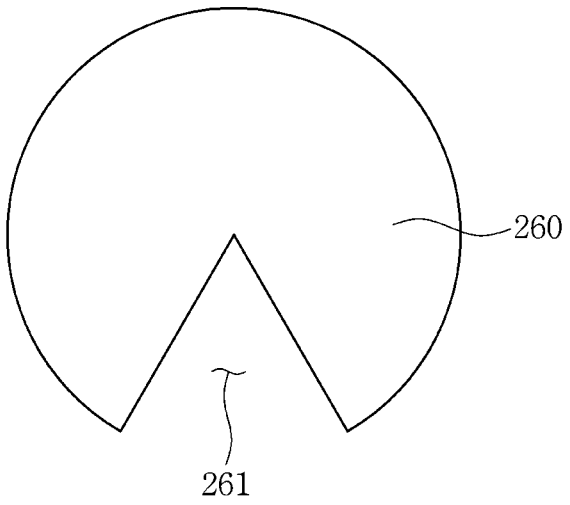
FIG. 4 is a plan view illustrating an auxiliary support portion of FIG. 1.

FIG. 4 is a plan view illustrating the auxiliary support portion 260 of FIG. 1.

Referring to FIGS. 3 and 4, the auxiliary support portion 260 is connected to the first rotation shaft 213 and along with the main support portion 250, supports the ball B to be inserted into the ball transfer tube 100. The auxiliary support portion 260 receives a power from the driving motor 230 and rotates together with the first rotating portion 210.

The auxiliary support portion 260 according to an exemplary embodiment has a shape of a circular plate having a support groove 261. A portion of the auxiliary support portion 260 is inserted into the first opening 111 of the ball lifting tube 130, and rotates through the first opening 111.

The support groove 261 is defined so that the ball B may be mounted thereon and the lifted ball B is transferred while being mounted on the support groove 261. Accordingly, the auxiliary support portion 260 has the support groove 261 having a larger width than that of the ball B.

Figure 5:
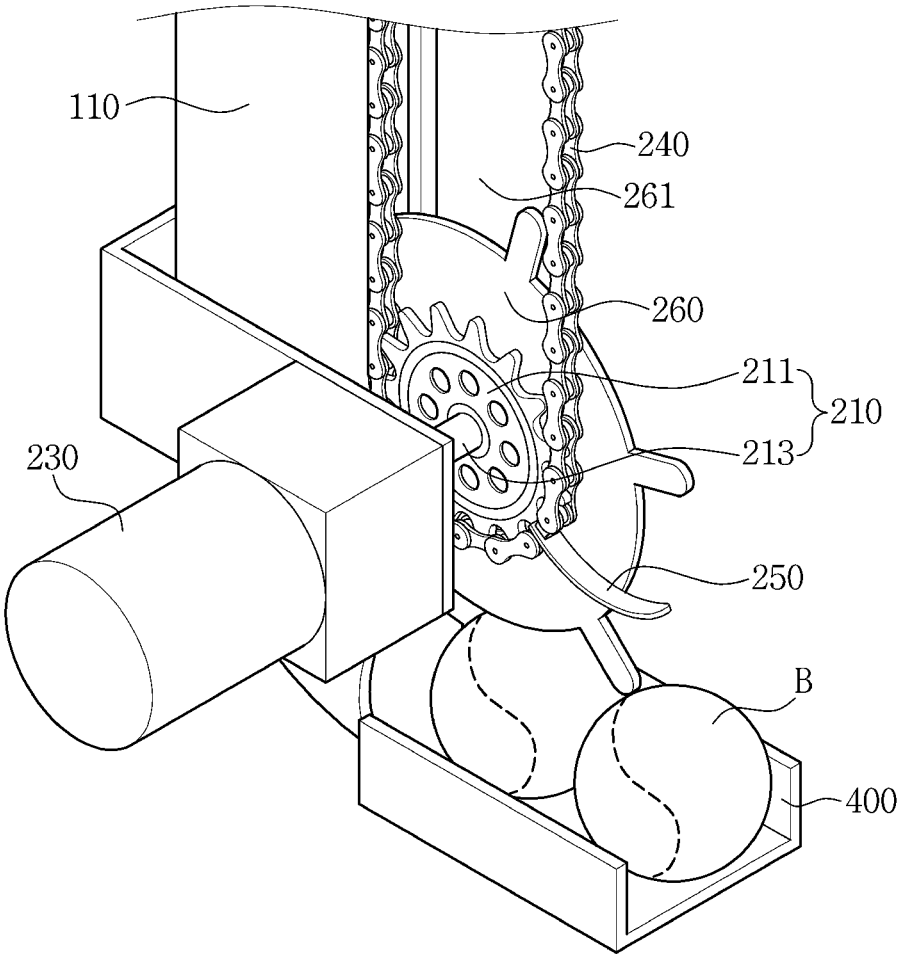
FIG. 5 is an enlarged view illustrating a ball feeding device according to an alternative exemplary embodiment.
Figure 6:
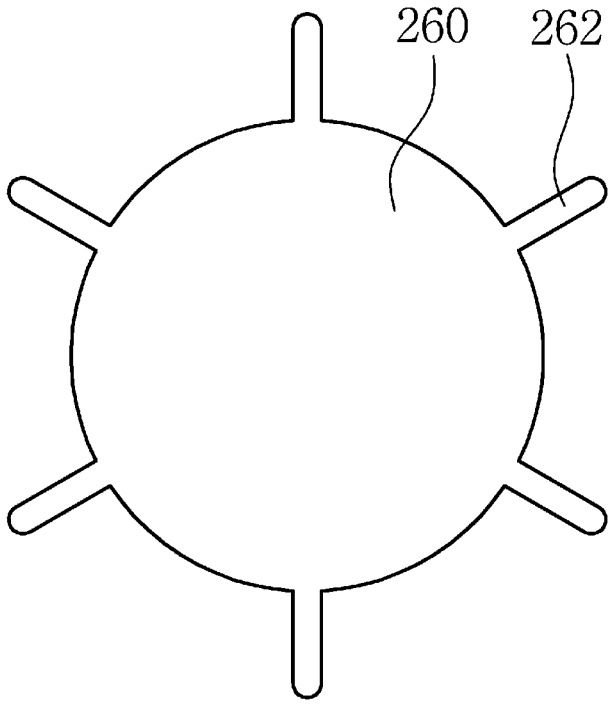
FIG. 6 is a plan view illustrating an auxiliary support portion according to an alternative exemplary embodiment.

FIG. 5 is an enlarged view illustrating a ball feeding device according to an alternative exemplary embodiment, and FIG. 6 is a plan view illustrating an auxiliary support unit 260 according to an alternative exemplary embodiment.

Referring to FIGS. 5 and 6, the auxiliary support portion 260 according to an alternative exemplary embodiment is in the shape of a circular plate including a support protrusion 262. At least one support protrusion 262 is disposed along an outer circumferential surface of the auxiliary support portion 260. As an example, the support protrusion 262 may be a stick or a bar. The support protrusion 262 rotates through a first opening 111 by rotation of a driving motor 230.

As another example, the support protrusion 262 may have a predetermined curved surface. The support protrusions 262 may be bent in a direction different from a direction in which a main support portion 250 is bent. In such an exemplary embodiment, the support protrusion 262 may effectively transfer the ball B to a ball transfer tube 100. A length of the support protrusion 262 may be, for example, one quarter or more of an outer circumferential surface of the ball B.

The support protrusion 262 supports the ball B. For example, the support protrusion 262 of the auxiliary support portion 260 supports the ball B and transfers the ball B to the ball transfer tube 100 by the rotation of the driving motor 230.

The ball detection sensor 300 is disposed at the ball feeding tube 130 to sense whether the ball B has passed or not.

The ball detection sensor 300 may be a contact-type sensor (e.g., a limit switch). In such an exemplary embodiment, for example, the ball detection sensor 300 may be disposed inside the ball feeding tube 130. When the ball B contacts the ball detection sensor 300 in the process of passing through the ball feeding tube 130, rotation of the driving motor 230 is stopped for a predetermined time.

In one embodiment, the ball detection sensor 300 may be an ultra-high speed camera sensor. The ultra-high speed camera sensor may capture the movement of the ball at high speed, convert it into an image, and recognize the passing of the ball through image processing.

In another embodiment, the ball detection sensor 300 may be an optical sensor. An infrared sensor includes a light transmitter and a light receiver provided at the ball feeding tube 130. The light transmitter emits a light, and the light receiver of the optical sensor receives and recognizes a light reflected by the ball B or the ball feeding tube 130. Accordingly, the optical sensor may recognize whether the ball B has passed or not.

The ball guide portion 400 is connected to a lower end portion of the ball lifting tube 110 to guide the ball B to be inserted to the ball lifting tube 110. The ball guide portion 400 is designed to have a size similar to that of an inlet portion of the ball lifting tube 110. For example, the ball guide portion 400 may contact an outer side of the ball lifting tube 110 to be connected thereto. However, exemplary embodiments are not limited thereto, and the ball guide portion 400 may contact an inner side of the ball lifting tube 110 to be connected thereto.

Hereinabove, configurations of the ball feeding device 10 according to an exemplary embodiment has been described. Hereinafter, an operation of the ball feeding apparatus 10 according to an exemplary embodiment will be described.

Figure 7:
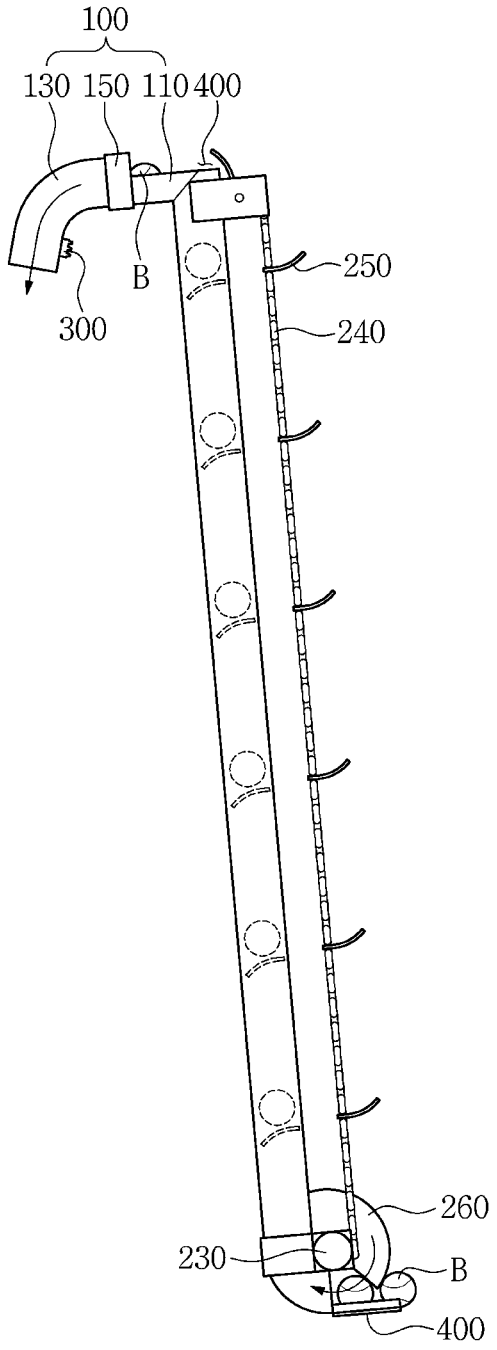
FIG. 7 is an explanatory view illustrating an operation of the ball feeding device illustrated in FIG. 1.

FIG. 7 is an explanatory view illustrating an operation of the ball feeding device 10 illustrated in FIG. 1. Referring to FIG. 7, in the case where the ball B is not detected by the ball detection sensor 300, the ball transfer module 200 is driven. When the driving motor 230 is driven, the driving motor 230 transmits a power to the first rotating portion 210. The first rotating portion 210 receives the power, rotates in engagement with the link 240, and turns the link 240. The link 240 may turn in a clockwise direction (e.g., a direction "a" in the drawing), for example. In addition, at least a portion of the link 240 is inserted into the first opening 111 and turns along the ball lifting tube 110.

In accordance with the rotation of the first rotation portion 210, the main support portion 250 and the auxiliary support portion 260 are also turned. In such an exemplary embodiment, the ball B at the ball guide portion 400 is supported by the main support portion 250 and the auxiliary support portion 260 to enter the ball lifting tube 110 through a lower end thereof. The lifted ball B is supported by the main support portion 250, and ascends to an end of the ball lifting tube 110 in accordance with the turning of the link 240 through the ball lifting tube 110.

Subsequently, the ball B falls along the curved surface of the main support portion 250. As the ball feeding tube 130 is bent at a predetermined angle toward the ground, the ball B moves from the ball lifting tube 110 toward the ball feeding tube 130.

The ball B passes through the ball feeding tube 130 and contacts the ball detection sensor 300. In one embodiment, the ball detection sensor 300 may be a contact-type sensor. Accordingly, when the ball B contacts the ball detection sensor 300, the ball transfer module 200 may stop.

Figure 8:
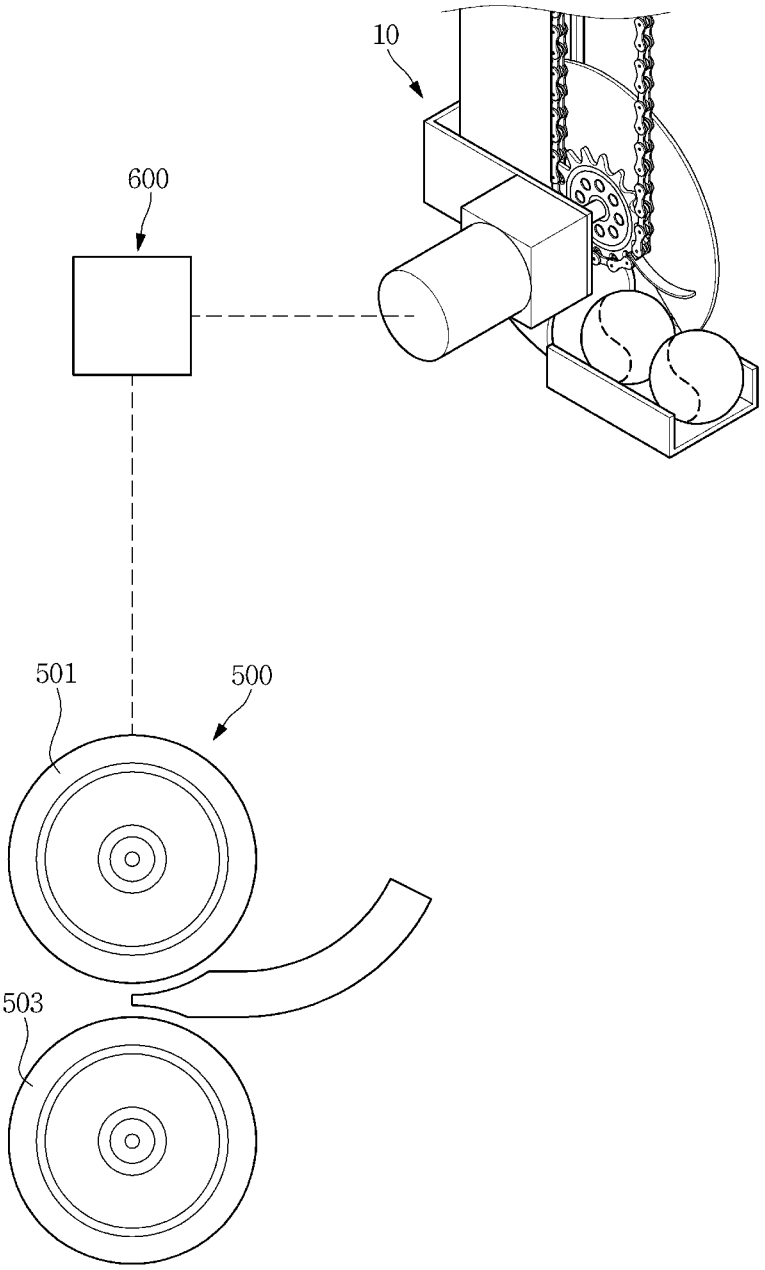
FIGS. 8 and 9 are views illustrating a control unit and a pitching unit according to an exemplary embodiment.
Figure 9:
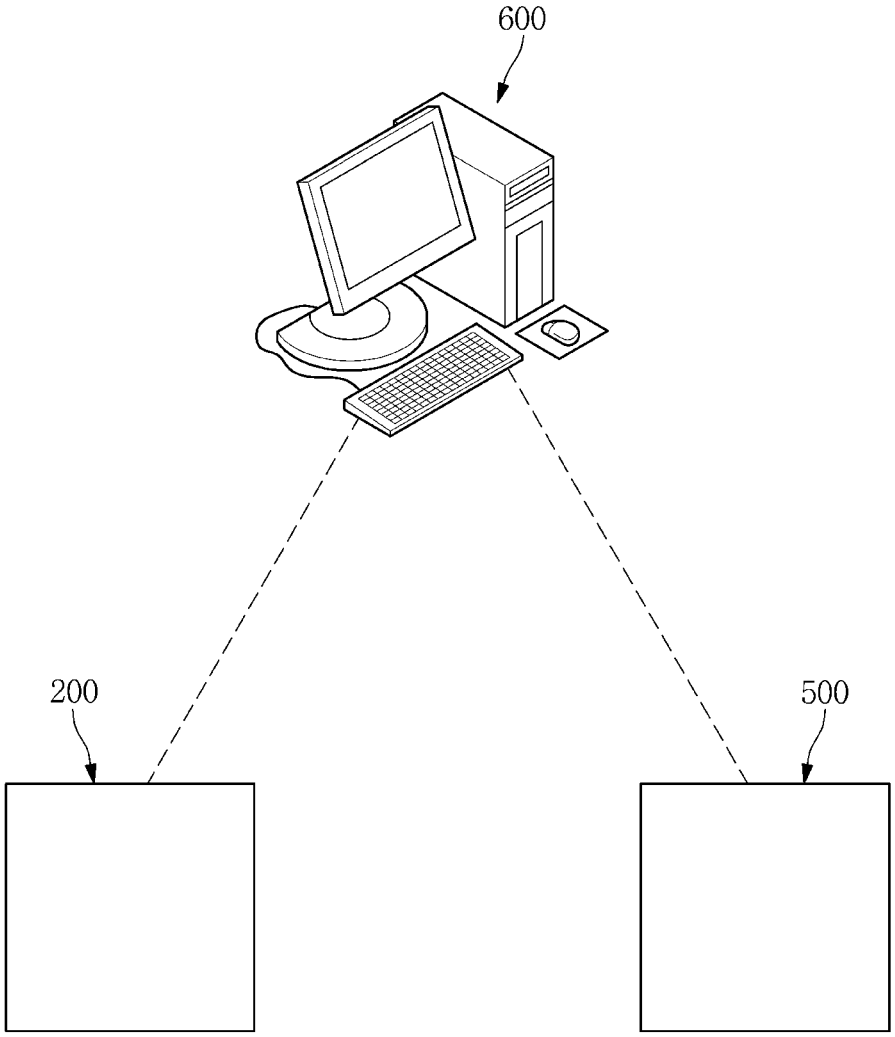

FIGS. 8 and 9 are views illustrating a control unit 600 and the pitching unit 500 according to an exemplary embodiment.

Referring to FIGS. 8 and 9, the pitching unit 500 includes a first pitching wheel 501 and a second pitching wheel 503. The first pitching wheel 501 and the second pitching wheel 503 are connected to a first wheel motor and a second wheel motor, respectively. The first pitching wheel 501 and the second pitching wheel 503 are rotated in different directions by the first and second wheel motors, respectively. Accordingly, the ball B may pass between the first pitching wheel 501 and the second pitching wheel 503 to be pitched.

The control unit 600 controls operations of the ball transfer module 200 and the pitching unit 500. For example, the control unit 600 controls the driving motor 230 of the ball transfer module 200. The control unit 600 transmits a first signal to the driving motor 230. The driving motor 230 operates in response to the first signal. The driving motor 230 rotates the first rotating portion 210 according to the first signal.

In addition, the control unit 600 transmits a second signal to the pitching unit 500. The pitching unit 500 operates in response to the second signal. That is, the ball B is discharged from the pitching unit 500.

Figure 10:
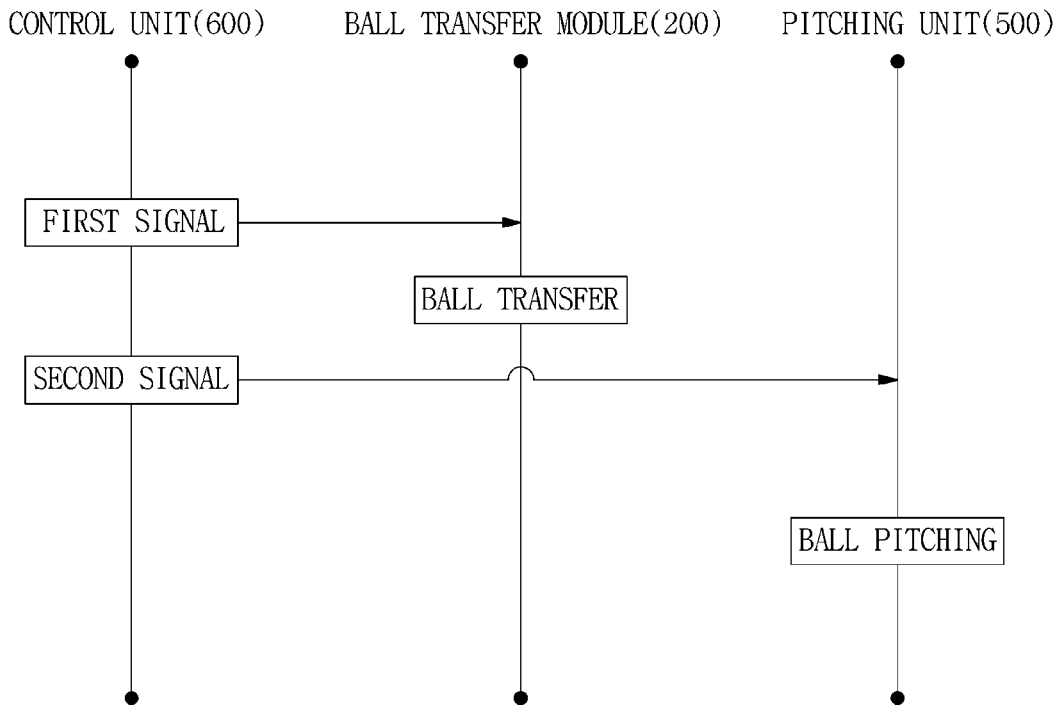
FIG. 10 is an explanatory view illustrating a method of controlling the control unit illustrated in FIG. 9.

FIG. 10 is an explanatory view illustrating a method of controlling the control unit 600 illustrated in FIG. 9.

Referring to FIG. 10, the control unit 600 may drive the ball transfer module 200 and the pitching unit 500 in order. For example, the control unit 600 transmits the first signal to the ball transfer module 200. The control unit 600 transmits the second signal to the pitching unit 500 after a preset time has elapsed. That is, the control unit 600 transmits the second signal to the pitching unit 500 after a predetermined time elapses after the first signal is applied.

In such an exemplary embodiment, the predetermined time is a time set for delaying an operation of the pitching unit 500 after an operation of the ball transfer module 200. The predetermined time may be set in advance using the control unit 600. For example, the predetermined time may be between 2 seconds to 5 seconds. Accordingly, when the control unit 600 transmits the first signal to the ball transfer module 200, the ball transfer module 200 lifts a ball from the ground to supply the ball to the pitching unit 500. In addition, the control unit 600 transmits the second signal to the pitching unit 500 after the predetermined time has elapsed. Accordingly, the ball supplied from the ball feeding device 10 may be pitched by the pitching unit 500.

As set forth hereinabove, in one or more embodiments of the present invention, the ball feeding device may transfer balls to a predetermined height and may supply the balls to a pitching machine.

In addition, the ball feeding device may further include a pitching unit connected to a ball feeding tube, and a control unit controlling operations of a ball transfer module and a pitching unit. The control unit sequentially operates the ball transfer module and the pitching unit.

From the foregoing, it will be appreciated that various embodiments in accordance with the present disclosure have been described herein for purposes of illustration, and that various modifications may be made without departing from the scope and spirit of the present teachings. Accordingly, the various embodiments disclosed herein are not intended to be limiting of the true scope and spirit of the present teachings. Various features of the above described and other embodiments may be mixed and matched in any manner, to produce further embodiments consistent with the invention.

What is claimed is:

1. A ball feeding device comprising:

a ball transfer tube comprising a ball lifting tube and a ball feeding tube; and a ball transfer module connected to the ball lifting tube and transferring the ball;

wherein the ball transfer module comprises:

a first rotating portion and a second rotating portion connected to opposite end portions of the ball lifting tube, respectively;

a driving motor connected to the first rotating portion;

a link connecting the first rotating portion and the second rotating portion; and a main support portion supporting the ball, the main support portion coupled to the link and passing through the ball lifting tube.

2. The ball feeding device as claimed in claim 1, wherein the first rotating portion comprises a first sprocket and a first rotation shaft, the second rotating portion comprises a second sprocket and a second rotation shaft, and the link comprises a chain.

3. The ball feeding device as claimed in claim 2, further comprising brackets fixed to the ball lifting tube, wherein opposite end portions of each of the first rotation shaft and the second rotation shaft are supported by the brackets.

4. The ball feeding device as claimed in claim 1, wherein at least a portion of the link moves while being inserted in the ball lifting tube.

5. The ball feeding device as claimed in claim 4, wherein the ball lifting tube has a first opening defined in a side surface, and the link is inserted into the first opening.

6. The ball feeding device as claimed in claim 5, wherein the ball transfer module further comprises:

an auxiliary support portion pivotally connected to the driving motor and supporting a ball, at least a portion of the auxiliary support portion being inserted into the first opening of the ball transfer tube.

7. The ball feeding device as claimed in claim 6, wherein the auxiliary support portion comprises a portion having a circular plate shape having a support groove on a portion of a circumference of the circular plate.

8. The ball feeding device as claimed in claim 6, wherein the auxiliary support portion comprises a portion having a circular plate shape comprising a support protrusion on an outer circumferential surface of the circular plate.

9. The ball feeding device as claimed in claim 6, wherein an interval among the main support portions is substantially the same as a length of an outer circumference of the first rotating portion.

10. The ball feeding device as claimed in claim 1, wherein the main support portion comprises a curved surface convex toward a moving direction of the link.

11. The ball feeding device as claimed in claim 1, wherein the ball lifting tube has a second opening defined in an upper surface thereof.

12. The ball feeding device as claimed in claim 1, further comprising a ball detection sensor at the ball transfer tube, the ball detection sensor detecting that the ball passes through a predetermined position.

13. The ball feeding device as claimed in claim 1, wherein the ball transfer tube has a predetermined inclination with respect to a horizontal plane.

14. The ball feeding device as claimed in claim 1, further comprising a ball guide portion connected to the ball lifting tube.

15. The ball feeding device as claimed in claim 1, further comprising:

a pitching unit connected to the ball feeding tube and pitching a ball; and a control unit controlling operations of the ball transfer module and the pitching unit.

16. The ball feeding device as claimed in claim 15, wherein the control unit applies, to the ball feeding device, a first signal for transferring a ball to the pitching unit and applies, to the pitching unit, a second signal for pitching the ball.

17. The ball feeding device as claimed in claim 16, wherein the control unit applies the second signal after a predetermined time elapses after the first signal is applied.

* * * * *